United States Patent [19]

Wada

[11] 4,377,538

[45] Mar. 22, 1983

[54] VARIABLE VENTURI TYPE CARBURETOR

[75] Inventor: Satomi Wada, Ohbu, Japan

[73] Assignee: Aisan Industry, Co., Ltd., Aichi, Japan

[21] Appl. No.: 277,361

[22] Filed: Jun. 25, 1981

[30] Foreign Application Priority Data

Jul. 11, 1980 [JP] Japan ..... 55-98361[U]

[51] Int. Cl.[3] ..... F02M 9/06

[52] U.S. Cl. ..... 261/44 C; 261/65

[58] Field of Search ..... 261/44 C, 65

[56] References Cited

U.S. PATENT DOCUMENTS

| | | | |
|---|---|---|---|
| 1,868,831 | 7/1932 | Heitger | 261/65 |
| 2,080,440 | 5/1937 | Scott | 261/65 |
| 2,110,211 | 3/1938 | Farrell | 261/65 |
| 2,759,716 | 8/1956 | Jones | 261/65 |
| 3,410,539 | 11/1968 | Walker | 261/65 |
| 3,437,320 | 4/1969 | Walker et al. | 261/65 |
| 3,785,628 | 1/1974 | Lang | 261/65 |
| 3,875,266 | 4/1975 | Fonagy | 261/65 |
| 4,289,715 | 9/1981 | Ito et al. | 261/44 C |
| 4,302,405 | 11/1981 | Inoue et al. | 261/44 C |

FOREIGN PATENT DOCUMENTS

| | | | |
|---|---|---|---|
| 52-16175 | 5/1977 | Japan . | |
| 54-30320 | 3/1979 | Japan . | |
| 54-35521 | 3/1979 | Japan . | |
| 207926 | 12/1923 | United Kingdom | 261/65 |
| 1151802 | 5/1969 | United Kingdom | 261/44 C |
| 1479730 | 7/1977 | United Kingdom | 261/44 C |

*Primary Examiner*—Tim R. Miles

[57] ABSTRACT

A variable venturi type carburetor having a suction piston adapted to be moved toward and away from an opposing wall of the intake barrel in response to a change in the intake air flow rate so as to change the area of the venturi portion. The carburetor has a throttle valve with a tube-formed fuel introduction port through which the space defined at both sides of the throttle valve are communicated with each other. The fuel introduction port is so arranged that its upstream side end opening facing the suction piston is directed toward the wall to which the fuel discharged from the main jet is attached when the opening degree of the throttle valve is small.

5 Claims, 1 Drawing Figure

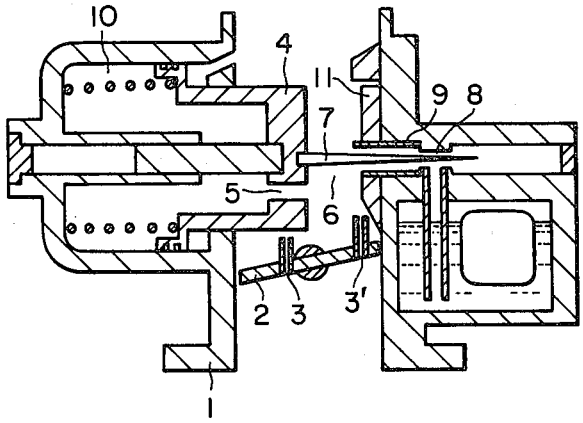
10
4
11
9
8
7
5
6
2
3
3'
1

VARIABLE VENTURI TYPE CARBURETOR

BACKGROUND OF THE INVENTION

1. Field of the Invention

The present invention relates to a variable venturi type carburetor and, more particularly, to a variable venturi type carburetor which can diminish the fluctuation of air-fuel ratio when the flow rate of intake air is small and can stabilize the idling operation of engine.

2. Description of the Prior Art

Recently, such a technique has been developed as to make it possible to operate engines with a lean mixture and to obtain a stable idling operation at reduced speed, in order to achieve a fuel economy. In conventional carburetors, these aims are achieved by improving the slow fuel system. However, in variable venturi type carburetors in which the air-fuel ratio is controlled through the control of the annular area between a main jet and a metering needle, the provision of the slow fuel system often results in impaired driveability because of difficulty in adaptation of the main jet to the metering needle and inadequate transient characteristics between the slow region and main region.

SUMMARY OF THE INVENTION

Under these circumstances, the present invention aims at providing a variable venturi type carburetor in which no slow fuel system is provided and the supply of fuel is made through a single main nozzle. During engine operation with a small intake air flow, the fuel supplied through the main nozzle is introduced to the downstream side of a throttle valve through a fuel introduction port provided in the throttle valve to stabilize the fuel supply to the engine.

The above and other objects, as well as advantageous features of the invention will become clear from the following description of the preferred embodiments taken in conjunction with the accompanying drawings.

BRIEF DESCRIPTION OF THE DRAWING

The attached sole FIGURE is a sectional view of a variable venturi type carburetor constructed in accordance with an embodiment of the invention.

DESCRIPTION OF THE PREFERRED EMBODIMENTS

A preferred embodiment of the invention will be described hereinunder with reference to the attached FIGURE.

A variable venturi type carburetor embodying the present invention, generally designated at a reference numeral 1, has a throttle valve 2 in which formed is a tube-formed fuel introduction port 3 or 3' in such a manner as to project from the obverse side of the throttle valve 2 adjacent to a later-mentioned suction valve. Thus, the spaces defined at both sides of the throttle valve 2 are communicated with each other through the fuel introduction port 3 or 3'. A venturi portion 6 is formed at the area above the fuel introduction port 3 by the suction piston 4 and a plate 11 opposing to the suction piston 4. The vacuum established at the venturi portion 6 is applied to a suction chamber 10 through a passage 5 to force out or retract the suction piston 4 in accordance with the flow rate of intake air. In consequence, a metering needle 7 fixed to the suction piston 4 is moved relatively to a main jet 8 provided in the carburetor barrel to meter the fuel to be discharged to the venturi portion 6.

The variable venturi type carburetor of the invention having the construction explained above operates in a manner described hereinafter.

When the opening degree of the throttle valve 2 is small, i.e. when the flow rate of the intake air flowing in the carburetor 1 is small, the flow velocity of the air passing through the venturi portion 6 is low. The fuel discharged to the venturi portion at a rate metered by the metering needle 7 and the main jet 8 is divided into a first portion which flows along the metering needle, and attaches to the suction piston 4 and a second portion which flows along the opposing wall, i.e. plate 11. According to the invention, since the fuel introduction ports 3 and 3' provided in the throttle valve are located under the suction piston 4 and the plate 11, the fuel flowing along the suction piston 4 and the plate 11 is induced by the action of the vacuum established in the intake manifold of the engine through the fuel introduction ports 3 and 3' and is supplied to the downstream side of the throttle valve through the fuel introduction ports 3 and 3'.

The suction piston is moved as the throttle valve is opened gradually. However, the movement of the throttle valve in the opening direction is necessarily accompanied by the corresponding movement of the fuel introduction ports 3 and 3'. Thus, the fuel introduction ports 3 and 3' are moved substantially in the translational manner with respect to the movement of the suction piston, so that the above-explained operation is maintained over a substantial region of engine operation.

It will be seen from the foregoing description that, in the variable venturi type carburetor of the invention, the engine can have stable operation even in the region of the small flow rate of intake air, in spite of the elimination of the slow fuel system. This stable engine operation in turn permits the use of leaner fuel mixture to achieve a fuel economy. The extended ends of the extension tubes of the fuel introduction ports face the suction piston and the lower part of the plate in their vicinity. In addition, since the vacuum established in the intake manifold is directly applied to the upstream side of the throttle valve, the fuel is more effectively atomized than in the conventional carburetor in which the fuel flows along or in contact with the wall of the intake barrel. The elimination of the slow fuel system further obviates the problems concerning the transient characteristic between the slow and main regions, and permits a reduction in the manufacturing cost.

What is claimed is:

1. In a variable venturi carburetor having a suction piston adapted to be moved back and forth in accordance with changes in the flow rate of intake air so as to change the area of a venturi portion adjacent thereto into which fuel is discharged, and a throttle valve provided at a downstream side of said suction piston, the improvement comprising means comprising two fuel introduction ports in said throttle valve provided at the downstream side of said suction piston, said fuel introduction ports including two tubes and having upstream side openings respectively extending through said tubes defining extended ends thereof respectively, and disposed such that when an open position of said throttle valve is such that a degree of opening thereof is relatively small, the extended end of one of said ports is directed toward a side wall of said suction piston to which discharged fuel attaches, and the extended end of the other of said ports is directed toward a carburetor wall opposing said suction piston, the discharged fuel also attaching to said carburetor wall.

2. In a variable venturi carburetor having a fuel metering jet for dispensing fuel to a venturi in said carburetor defined by an inner surface of said carburetor, said inner surface being comprised in part by a sidewall of the venturi and a suction piston adapted to be translationally moved back and forth in accordance with changes in the flow rate of intake air so as to change the area of the venturi, and a rotatable throttle valve at the downstream side of said suction piston having an idle limit position wherein the throttle valve has a predetermined small opening, the improvement comprising fuel-receiving means disposed on said throttle valve including extension means extending from the upstream side of said throttle valve operable with rotation of the latter to move substantially translationally with said suction piston in close proximity to a portion of said inner surface thereof to receive fuel clinging to said inner surface when said throttle valve is at said idle limit position as well as during other positions of said throttle valve and corresponding positions of said suction piston, said fuel-receiving means comprise an opening through said throttle valve and said extension means includes a hollow tube member of predetermined length communicating with and extending from said opening.

3. The carburetor as set forth in claim 2, wherein said opening and said tube member are at a predetermined location on said throttle valve such that said tube member is in close proximity to said sidewall of said venturi when said throttle valve is at or near said idle limit position.

4. The carburetor as set forth in claim 2, wherein said opening and said tube member are at a predetermined location on said throttle valve such that said tube member is in close proximity to said suction piston when said throttle valve is at or near said idle limit position.

5. The carburetor as set forth in claim 2, wherein said throttle valve includes two of said openings, each said opening having a respective said tube member, one of said tube members being in close proximity to said sidewall of said venturi, and the other of said tube members being in close proximity to said suction piston when said throttle valve is at or near said idle limit position.

* * * * *